United States Patent [19]

Hara et al.

[11] Patent Number: 4,920,880

[45] Date of Patent: May 1, 1990

[54] CLEANING MACHINE FOR A PRINTER

[75] Inventors: Akira Hara; Minoru Ochiai, both of Tokyo, Japan

[73] Assignee: Baldwin-Japan Limited, Tokyo, Japan

[21] Appl. No.: 199,960

[22] Filed: May 26, 1988

[30] Foreign Application Priority Data

Jul. 10, 1987 [JP] Japan ..... 62-172405

[51] Int. Cl.[5] ..... B41F 35/00

[52] U.S. Cl. ..... 101/425; 101/423; 15/256.7

[58] Field of Search ..... 101/423, 424, 425; 118/42, 257; 15/256.51

[56] References Cited

U.S. PATENT DOCUMENTS

| | | | |
|---|---|---|---|
| 2,525,982 | 10/1950 | Wescott . | |
| 4,344,361 | 8/1982 | MacPhee et al. | 101/425 |
| 4,537,130 | 8/1985 | Theelacher | 101/425 |
| 4,651,644 | 3/1987 | Kaenpfe et al. | 101/423 |
| 4,757,763 | 7/1988 | MacPhee et al. | 101/425 |

FOREIGN PATENT DOCUMENTS

| | | | |
|---|---|---|---|
| 476011 | 8/1951 | Canada | 101/425 |
| 2804801 | 8/1979 | Fed. Rep. of Germany | 101/425 |
| 3005469 | 2/1980 | Fed. Rep. of Germany . | |
| 3005489 | 7/1987 | Fed. Rep. of Germany . | |
| 56-037068 | 8/1981 | Japan . | |
| 56-037069 | 8/1981 | Japan . | |
| 1093271 | 4/1982 | Japan . | |
| 1093272 | 4/1982 | Japan . | |
| 74656 | 4/1987 | Japan | 101/425 |

*Primary Examiner*—Edgar S. Burr
*Assistant Examiner*—Ren Yan
*Attorney, Agent, or Firm*—Morgan & Finnegan

[57] ABSTRACT

A cleaning machine for a printer is provided for cleaning an outer peripheral surface of a cylinder of the printer with a cleaning cloth through a pressure pad mounted through a holder on a mount member supported by side plates of the frame of the printer. The cleaning cloth is moved relative to the outer peripheral surface of the cylinder of the printer. The pressure pad is composed of a projected member made of elastic material. The projected member includes a flange portion, a first projected portion toward the cylinder and a second projected portion projected toward the mount member. The first and second projected portion is symmetric with each other for reversible use, resulting in prolonging the service life of the pressure pad.

9 Claims, 3 Drawing Sheets

CLEANING MACHINE FOR A PRINTER

BACKGROUND OF THE INVENTION

1. Field of the Invention

The present invention relates to a cleaning machine for a printer cylinder such as a blanket cylinder of an offset printer and a plate cylinder of a gravure printer by pressing a cleaning cloth onto an outer peripheral surface of the cylinder by means of a pressure pad, and more particularly, to a long service life pressure pad for a cleaning machine of a printer.

2. Description of the Prior Art

The following explanation will be made as to a blanket cylinder cleaning machine for an offset printer but a gravure printer cylinder may be cleaned in the same way.

An offset printer usually has three cylinders, namely, a plate cylinder, a blanket cylinder and an impression cylinder. These cylinders are arranged such that their axes extend in parallel with one another and such that they can be brought into mutual contact. A sheet-like blanket made of rubber or the like is wound over an outer peripheral surface of a blanket cylinder of a printer. A pair of a cleaning cloth supply roll and a cleaning cloth take-up roll are rotatably supported in parallel to a longitudinal axis of the blanket cylinder on a pair of side plates mounted on both side frames of a printer body. A continuous cleaning cloth is wound at its both ends around the rolls by applying with a predetermined tension. The cleaning cloth take-up roll is driven to rotate at a predetermined speed by a drive means to take up the cleaning cloth thereon. A stay having a substantially T-shaped cross-section is provided to extend in parallel with an axial direction of the rolls with its ends being fixed to the side plates. A pressure pad made of elastic material such as rubber is provided in air-tight contact with a surface of the stay facing the blanket cylinder. A plenum chamber defined by the end of the stay and the pressure pad is in communication with an air compressor provided in the outside. When air is supplied to the plenum chamber, the pressure pad is inflated or expanded so that the cleaning cloth will be pressed against the outer peripheral surface of the blanket. During the pressure contact with the rotating blanket cylinder, contaminants on the blanket is wiped off by the cleaning cloth.

An another conventional cleaning machine of a printer has a pressure pad composed of a projected solid member made of rubber or the like. The pressure pad has a flange portion and a projected portion and is mounted through a holder on a mount member supported integrally with the side plate.

The projected portion of the pressure pad abuts against the cleaning cloth. The side plates are moved toward the blanket cylinder so that the cleaning cloth is pressed against the blanket thereby cleaning the blanket surface by the cleaning cloth.

In the foregoing coventional machines, the pressure pad is worn down or deformed due to friction against the cleaning cloth or is likely to be damaged due to a mechanical shock. Therefore, it is necessary to replace the pressure pad by new one normally after 10,000 to 20,000 times in use. Thus, the conventional techniques suffer from a disadvantage in which a durable service life of the pressure pad is relatively short.

SUMMARY OF THE INVENTION

An object of the present invention is to provide a pressure pad having a novel structure for a cylinder cleaning machine for a printer, which pressure pad is available for a reversible use.

To this end, according to the present invention, in a cleaning machine for a printer for cleaning an outer peripheral surface of a cylinder of the printer with a cleaning cloth through a pressure pad mounted through a holder on a mount member supported by side plates of the frame of the printer, the cleaning cloth being moved relative to the outer peripheral surface of the cylinder of the printer, the cleaning machine is characterized in that the pressure pad is composed of a projected member made of elastic material, the projected member including a flange portion, a first projected portion projected toward the cylinder and a second projected portion projected toward the mount member, the first and second projected portion being symmetric with each other.

According to the above structure, first the first projected portion of the pressure pad is used for cleaning the outer peripheral surface of the cylinder. Then, in the case where the first projected portion of the pressure pad is not usable due to the abrasion thereof, the pressure pad is reversed and mounted on the mount member. Thus, it is possible to carry out a cleaning operation with the second projected portion. Accordingly, it is possible to prolong a service life of the pressure pad.

DESCRIPTION OF THE PREFERRED EMBODIMENTS

The present invention will now be described with reference to the accompanying drawings.

Figure 6:
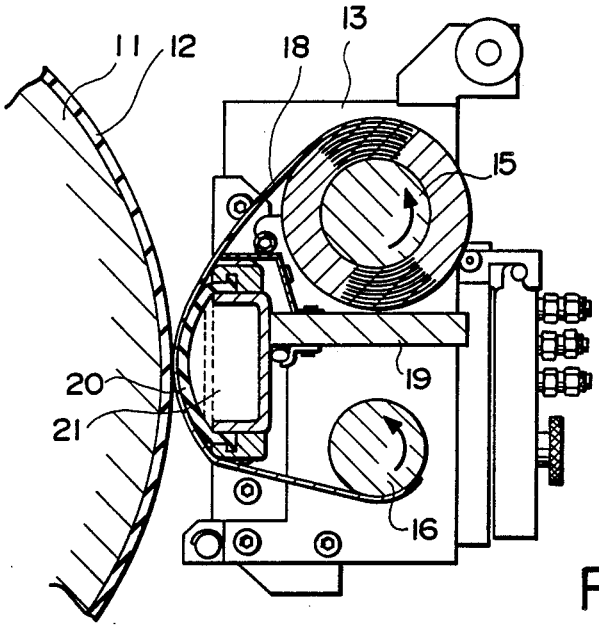
Fig. 6 PRIOR ART
FIG. 6 is a cross-sectional view showing a conventional cylinder cleaning machine for a printer.

FIG. 6 shows an example of a conventional printer cylinder cleaning machine, in which a sheet-like blanket 12 made of rubber or the like is wound over an outer peripheral surface of a blanket cylinder 11 of a printer. A pair of cloth supply roll 15 and take-up roll 16 are rotatably supported in parallel to a longitudinal axis of the blanket cylinder 11 on a pair of side plates 13 (only one side is shown) mounted on both side frames of a printer body. A continuous cleaning cloth 18 is wound at its both ends around the rolls 15 and 16 with a predetermined tension. The cleaning cloth take-up roll 16 is driven to rotate at a predetermined speed by a drive means (not shown) to take up the cleaning cloth 18 thereon. A stay 19 having a substantially T-shaped cross-section is provided to extend in parallel with an axial direction of the rolls 15 and 16 with its ends being fixed to the side plates 13. A pressure pad 20 made of elastic material such as rubber is provided in air-tight contact with a surface of the stay 19 facing the blanket cylinder 11. A plenum chamber 21 defined by end portion of the stay 19 and the pressure pad 20 is in communication with an air compressor (not shown) provided in the outside. When air is supplied to the plenum chamber 21, the pressure pad 20 is inflated or expanded so that the cleaning cloth 18 will be pressed against the outer peripheral surface of the blanket 12. During the pressure contact with the rotating blanket cylinder, contaminants on the blanket 12 is wiped off and cleaned by the cleaning cloth 18.

Figure 7:
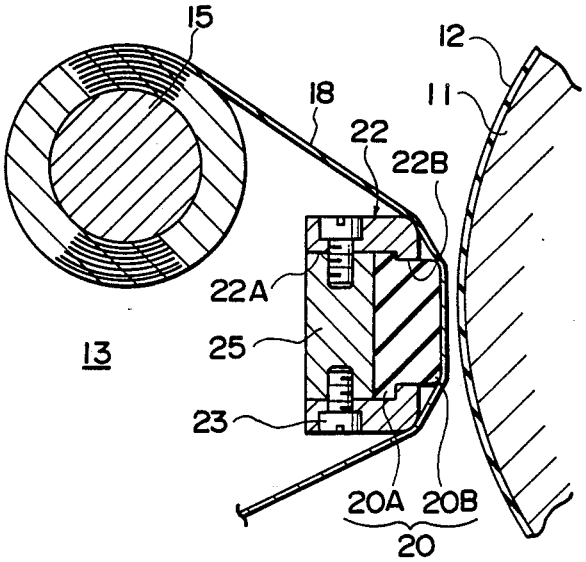
Fig. 7 PRIOR ART
FIG. 7 is a cross-sectional view showing another conventional cylinder cleaning apparatus for a printer.

FIG. 7 shows another example of a conventional cleaning machine of a printer, in which a pressure pad 20 is composed of a projected solid member made of rubber or the like. The pressure pad 20 has a flange portion 20A and a projected portion 20B and is mounted through a holder 22 on a mount member 25 supported integrally with the side plate 13. The mount member 25 is disposed on a line perpendicular to and passing through the axis of the blanket cylinder 11. The mount member 25 has a depth equal to or slightly smaller than an outer dimension of the flange portion 20A. In the holder 22, there are formed a recess 22A for receiving the flange portion 20A and a through-hole 22B that allows the projected portion 20B to expose outward.

When the pressure pad 20 is mounted on the mount member 25, the projected portion 20B is pressed so as to enter the through-hole 22B of the holder 22. Then, the mount member 25 is inserted into the recess 22A of the holder 22, and finally, the holder 22 is fixed to the mount member 25 by means of a plurality of fastening screws 23 so that a side wall of the flange portion 20A of the pressure pad 20 is brought into contact with the mount member 25.

The projected portion 20B of the pressure pad 20 abuts against the cleaning cloth 18. The side plates 13 are moved toward the blanket cylinder 11 so that the cleaning cloth 18 is pressed against the blanket 12 thereby cleaning the blanket surface by the cleaning cloth.

Figure 1:
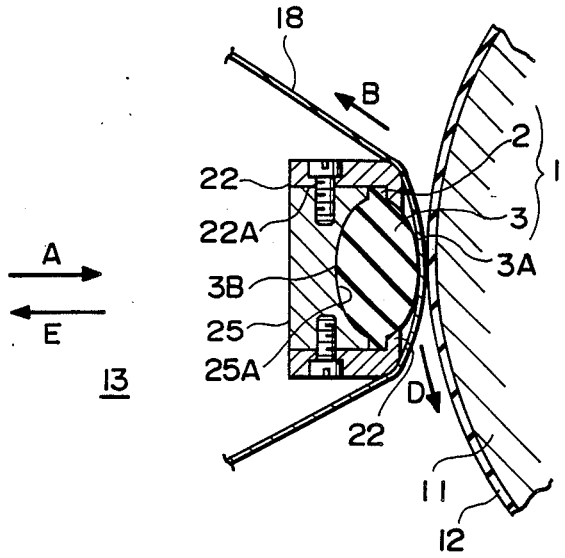
FIG. 1 is a view for illustrating an operational condition of a cleaning machine according to the present invention.

FIG. 1 shows an embodiment of the present invention in which the same reference numerals used to designate the like components in FIGS. 6 and 7. A pressure pad 1 is made of rubber or the like substantially in the form of an ellipse in cross-section. The pressure pad 1 is composed of a flange portion 2 and projected portions 3. The projected portions 3 includes a first projected portions 3A projected toward a blanket cylinder 11 and a second projected portion 3B projected toward a mount member 25. The first and second projected portions 3A and 3B are symmetric with each other. A recess 25A having a shape to correspond to that of the first and second projected portions 3A and 3B of the pressure pad 1 is formed in the mount member 25.

The pressure pad 1 is mounted on the mount member 25 so that either one of the projected portions, that is, the second projected portion 3B is received in the recess 25A of the mount member 25, and the flange portion 2 thereof is clamped between the mount member 25 and a holder 22.

Operation of the cleaning machine will now be described.

As shown in FIG. 1, the side plate 13 to which the mount member 25 is supported is moved periodically in a direction of an arrow A, the cleaning cloth 18 is brought into contact with an outer peripheral surface of the blanket 12 by the first projected portion 3A. Under such a positional relationship, the cleaning cloth 18 is drivingly moved relative to the blanket cylinder 11 in a direction of an arrow B, thereby cleaning the peripheral surface of the blanket 12.

In this case, the second projected portion 3B of the pressure pad 1 is held in contact with the entire region of the recess 25A of the mount member 25. Therefore, the recess 25A of the mount member 25 can withstand a rotational torque applied to the pressure pad 1 in the direction of an arrow D due to the rotation of the blanket cylinder 11. Thus, an undesirable displacement of the pressure pad 1 may be avoided and a stable mounting condition may be ensured.

In the case where the above-described cleaning operation has been repeated (normally 10,000 to 20,000 times) so that the first projected portion 3A has been worn down or cannot be used due to the friction of the cleaning cloth, the projected portions 3A of the pressure pad 1 are reversed for new use. In the reversing operation, the side plates 13 are first moved in a direction of an arrow E, so that the cleaning cloth 18 is separated apart from the outer peripheral surface of the blanket 12. Thereafter, fastening screws 23 are removed from the holder 22, and the holder 22 and the pressure pad 1 are removed from the mount member 25. Then, the pressure pad 1 is reversed so that the second projected portion 3B is exposed outside of the holder 22, while being held in the recess 22A of the holder 22. Finally, the mount member 25 is inserted into the recess 22A of the holder 22, the holder 22 is fixed to the mount member 25 by the fastening screws 23 so as to press the first projected portion 3A against the recess 25A of the mount member 25.

Figure 2:
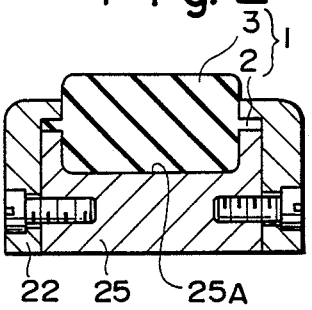
FIGS. 2 to 5 show various cross-sections for projected portions of a pressure pad.
Figure 3A:
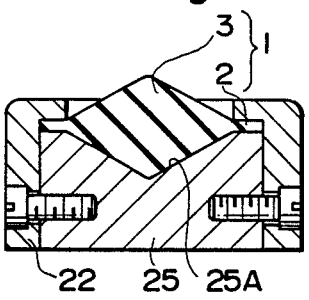
Figure 3B:
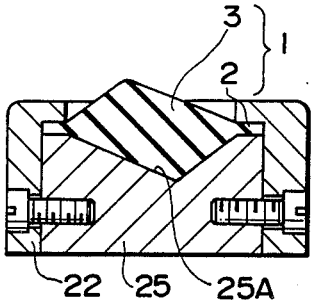
Figure 4:
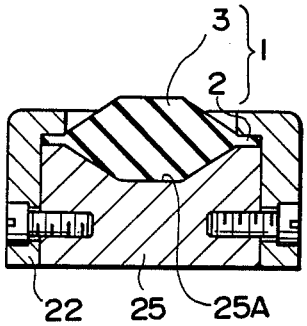
Figure 5:
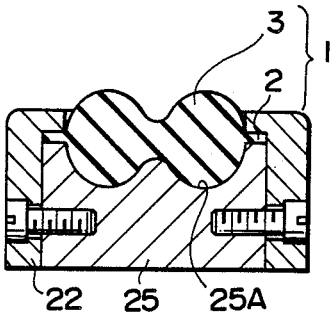

Also, the cross-section of the projected portions 3 of the pressure pad is not limited to an ellipse. For example, it is possible to form the cross-section in various shapes such as a rectangular shape, a rhombus and a parallelogram, respectively, shown in FIGS. 2, 3A and 3B. Also, the first and second projected portions 3A and 3B are in the form of trapezoids as shown in FIG. 4. Furthermore, two or more projected portions may be formed as shown in FIG. 5. Although the holder 22 is made of an integral unit in the foregoing embodiments, it is possible to separate the holder with respect to a line perpendicular to and passing through the axis of the blanket cylinder 11 as shown in FIG. 1.

As described above, according to the present invention, since it is possible to carry out the cleaning operation with the first and second projected portions by reversing the pressure pad, it is possible to considerably enhance the service life of the pressure pad. Also, since the pressure pad projected portion is pressed against the recess of the mount member, it is possible to mount the pressure pad in a stable condition.

What is claimed is:

1. A cleaning machine for cleaning a surface of a cylinder of a printer by means of a cleaning cloth which is selectively held in contact with said surface while said cylinder is rotating, said cleaning machine comprising a pressure pad reversible to present different useable surfaces and which has a cross-sectional shape symmetrical along a longitudinal axis thereof spaced from and extending parallel to the longitudinal axis of said cylinder, said pressure pad having a first projecting portion on a first side thereof facing said cylinder and a second identically shaped projecting portion on a second side opposite to said first side, said projecting portions each having an outer surface, said pressure pad being made of elastic material and provided with flanges, and said cleaning cloth being held in pressure contact with said surface of said cylinder by said pressure pad which is mounted parallel to said longitudinal axis of said cylinder and clamped to said cleaning machine by a holder, whereby said surface of said cylinder is cleaned by relative movement between said cleaning cloth and said surface of said cylinder and whereby either the respective outer surface of the first projecting portion or the outer surface of the second projecting portion of said pressure pad can be selectively used to hold said cleaning cloth in pressure contact with said surface of said cylinder by reversing the position of said pressure pad about said longitudinal axis of said pressure pad.

2. A cleaning machine according to claim 1, including a mounting member having a recess in which pressure pad is received in contact therewith.

3. A cleaning machine according to claim 1, wherein said elastic material comprises rubber.

4. A cleaning machine according to claim 1, wherein said pressure pad has a cross-section substantially in the form of an ellipse.

5. A cleaning machine according to claim 1, wherein said pressure pad has a rectangular shape in cross-section.

6. A cleaning machine according to claim 1, wherein said pressure pad has a cross-section substantially in the form of a rhombus.

7. A cleaning machine according to claim 1, wherein said pressure pad has a cross-section substantially in the form of a parallelogram.

8. A cleaning machine according to claim 1, wherein said first and second projecting portions have cross-sections substantially in the form of trapezoids.

9. A cleaning machine according to claim 1, wherein said projecting member has two or more projecting portions in cross-section.

* * * * *